US005503031A

United States Patent [19]

Scott et al.

[11] Patent Number: 5,503,031

[45] Date of Patent: Apr. 2, 1996

[54] GROUND WATER SAMPLING DEVICE

[75] Inventors: Gregory H. Scott; Thomas M. Christy, both of Salina; Melvin P. Kejr, Brookville, all of Kans.

[73] Assignee: Kejr Engineering, Inc., Salina, Kans.

[21] Appl. No.: 430,322

[22] Filed: Apr. 28, 1995

[51] Int. Cl.[6] ..... E21B 49/08

[52] U.S. Cl. ..... 73/864.74; 175/21

[58] Field of Search ..... 73/863.23, 864.34, 73/864.73, 864.74; 175/21, 58–60; 166/264

[56] References Cited

U.S. PATENT DOCUMENTS

| | | | |
|---|---|---|---|
| 4,028,248 | 6/1977 | Murauskas et al. . | |
| 4,807,707 | 2/1989 | Handley et al. | 175/21 |
| 5,146,998 | 9/1992 | Cordry et al. | 175/21 |
| 5,327,981 | 7/1994 | Morgan | 73/864.74 |

OTHER PUBLICATIONS

Pp. 5.1–5.12 of "Geoprobe Systems 1993–94 Equipment and Tools Catalog," and the ground water sampling tools depicted therein which were published, in public use or on sale in the U.S. prior to Apr. 28, 1994.

*Primary Examiner*—Robert Raevis
*Attorney, Agent, or Firm*—Shook, Hardy & Bacon

[57] ABSTRACT

A ground water sampling device has an elongated cylindrical hollow housing positioned at a desired depth below the ground surface. The housing has an opening formed at its lower end and an inner surface with an annular groove disposed adjacent the opening. The device has an elongated screen capable of being telescopically received in the housing and capable of being deployed through the opening of the housing. The screen has an annular slot formed on its outer surface adjacent its upper end. A resilient locking collar is compressed inwardly and received in the slot of the screen when the screen is received in the housing prior to its deployment. The collar expands outwardly into the groove of the housing when the slot of screen is longitudinally aligned with the groove during deployment of the screen. The collar in its expanded position is disposed in both the slot and the groove so that the screen is locked in its deployed position.

7 Claims, 2 Drawing Sheets

Fig.6.
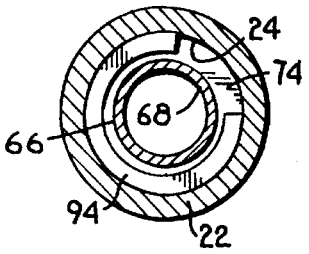
Fig.8.
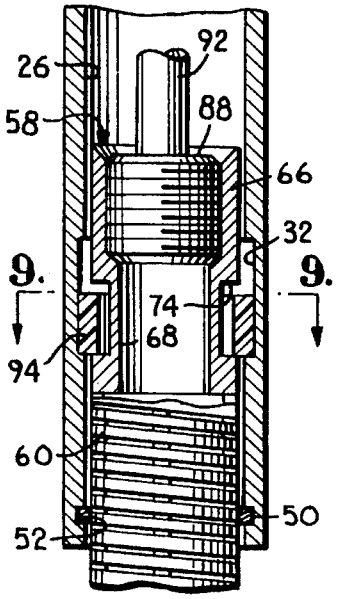
Fig.10.
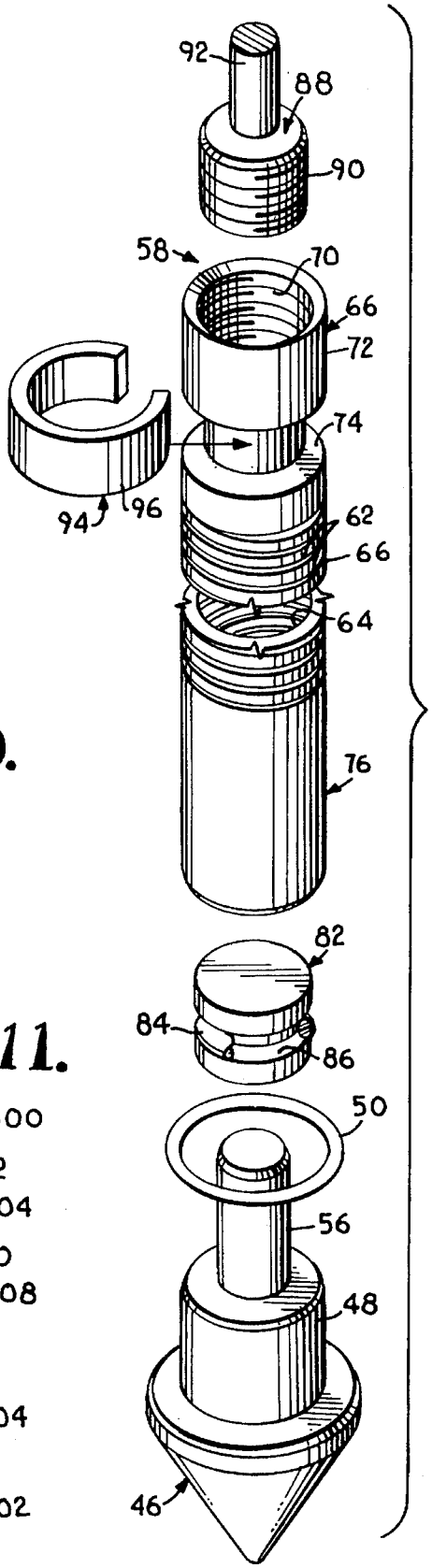
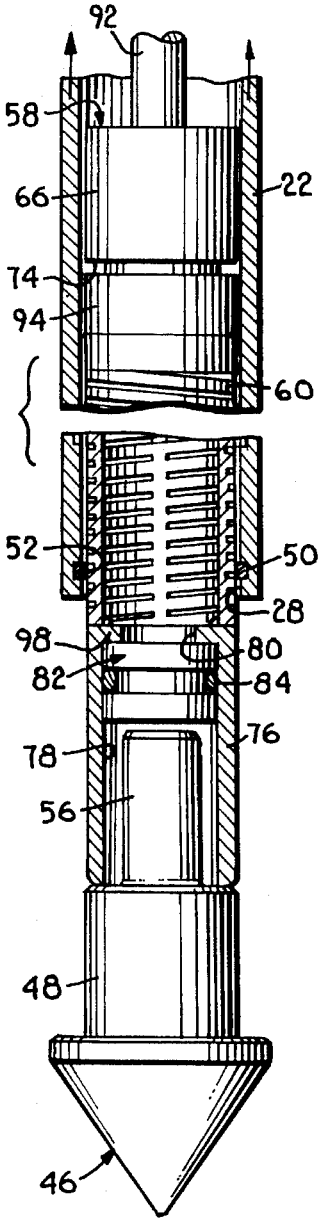
Fig.7.
Fig.9.
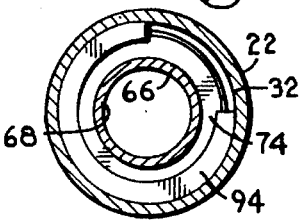
Fig.11.
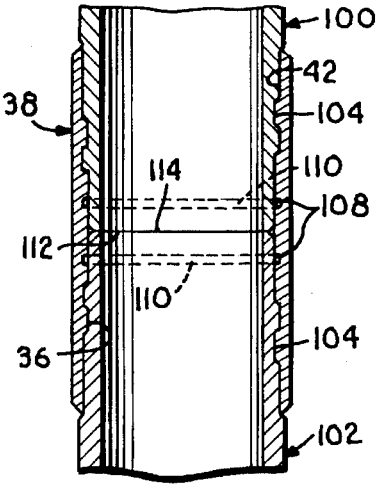

GROUND WATER SAMPLING DEVICE

This invention relates to a device for obtaining water samples below the surface of the ground.

For many years, ground water samples have been taken for studying chemical dissipation and residue, for determining the concentration of environmental contaminants, for investigating hazardous waste sites, and for other uses well known in the art.

Recently, sampling systems which utilize a percussion hammer have been used to drive sampling devices into the ground. One such system involves the placement of a semipermanent small diameter monitoring well into the ground at a desired location. The well is permanent in the sense that it is left at the desired location to take samples at intervals throughout an extended period of time. These types of wells normally consist of a string of hollow cylindrical casing sections extending downwardly into the ground to a desired depth and a hollow elongated screen extending out of the bottom end of the casing string. The screen has a mesh or slits which allow ground water to enter the interior of the screen but which prevents particles found in the ground water from entering.

Ground water can be sampled from the well by positioning flexible tubing down the interior of the casing string and into the interior of the screen. The end of the tubing extending out the upper end of the casing string is connected to a peristaltic pump to collect a ground water sample. In addition to utilizing a peristaltic pump to collect the sample, a bailer, which consists of a sealed tube with a check valve located on its lower end, can be lowered down the center of the casing via a wire until it engages the water collected in the screen and is filled by the displacement of the check valve. Upon removal of the bailer from the water in the screen, the check valve reseals the tube so that a sample of a particular volume is obtained. Further, a tubing extending down the casing with a check valve on its lower end can also be used to obtain a sample. More specifically, one end of the tubing extends out of the exposed upper end of the casing and is positioned in an open container. The end having the check valve, which is disposed in the water collected in the screen, is actuated up and down so that with each actuation a particular volume of ground water is forced upwardly within the tubing until water eventually flows from the upper open end of the tubing into the container.

To install the monitoring well in the ground, the string of casing sections is first driven downwardly using the hydraulic hammer. More specifically, a first section of casing to be driven into the ground has an expendable drive point positioned on its lower end. Additionally, a section of probe rod is positioned inside of the casing bore and engages the top of the drive point. The probe rod is used to convey most of the percussive forces from the hydraulic hammer to the drive point. Probe rod sections are typically thicker, more sturdy, and more able to bear the percussive forces of the hammer than the casing sections. The hammer acts upon the casing, but only to force the casing downwardly through the sample hole bored by the drive point.

The lengths of the casing sections used to comprise the casing string generally correspond to the lengths of the probe rod sections disposed within the casing. Therefore, after a particular section of casing and probe rod is driven into the ground, additional casing sections and probe rod sections can be added until a desired depth for the casing is reached.

After the desired depth of the casing string has been reached, the probe rod string is moved from the casing string. Typically, this is done by positioning a pull cap on the upper end of the probe rod string and removing the string one section at a time as is well known in the art. The screen is then lowered through the aligned bores of the casing sections by a plurality of connected thin rigid metal rod sections known as extension rods. The lower end of the extension rod string is threaded into a connecting member at the top of the screen. The lower end of the screen is typically closed. The screen is lowered within the casing until its closed lower end engages the expendable drive point. The screen is now ready to be deployed.

To deploy the screen, the operator applies downward pressure to the extension rod string while the casing is pulled upwardly a distance equal approximately to the length of the screen. Thus, the screen extends out the lower end of the lowest casing section and occupies the portion of the bore hole previously formed by the lowest casing section. Further, the lower sealed end of the screen rests upon the expendable drive point which was dislodged from its seat in the lowest casing section when the casing string was partially withdrawn.

Typically, to ensure that the screen does not pass completely out of the casing string, the screen has an annular ridge or shoulder extending outwardly from its outer surface adjacent its upper end. This shoulder engages an annular ledge positioned inside the lowest casing section adjacent its lower open end so that the upper end of the screen may not pass out of the lower end of the casing string. The ledge in the casing typically is provided by threading a collar into the lower end of the lowest casing section.

To prevent ground water from passing into the casing without first going through the screen, an O-ring typically is provided on the lower surface of the shoulder of the screen so that when the shoulder engages the ledge of the casing, a seal is formed therebetween. After the screen has been deployed, the extension rod string is disconnected from the screen and removed.

The above-described structure is disadvantageous for a number of reasons. First, because the shoulder of the screen and the ledge of the casing both extend into the bore of the casing string, the diameter of the screen must be substantially less than the diameter of the bore of the casing sections in order to allow the screen to pass by the ledge during deployment. Thus, a screen having a maximum diameter, that is, approximating the diameter of the casing bore, cannot be used.

Additionally, because only downward movement of the screen is prevented, and upward movement is allowed, the relative positions of the casing and the screen may change due to changing soil conditions or soil shifting over time. That is, the casing may be shifted downwardly over the screen, or the screen may be shifted upwardly within the casing. This shifting can result in inaccurate ground water samples due to the changed exposure of the screen. Furthermore, because such shifting can result in the shoulder of the screen being displaced from the ledge of the casing, the seal between the screen and the casing may be disturbed, thus allowing ground water to enter the casing without first passing through the screen. As is apparent, such an unsealed condition could result in contaminated water samples or damage to water sampling equipment due to particles found in the ground water.

A further disadvantage associated with the described device involves the fact that the relationship between the screen and the casing is not sealed during deployment, but only becomes sealed upon the screen reaching its fully deployed position. That is, during deployment of the screen, ground water can enter the casing without first passing into the interior of the screen. As described, such contamination can cause numerous problems with water sampling.

Another drawback associated with this type of monitoring well involves the abandonment of the well. More specifically, if a well is no longer needed and is to be abandoned, it is desirable to grout the bore hole in which it was positioned. In the past, the casing and screen were first extracted from the ground leaving an open hole. In order to grout the hole, a grouting device, such as tubing, was repositioned in the hole. Thus, an additional grouting process was required after the monitoring well was removed.

Other disadvantages of the described monitoring well structure involve the connections between casing sections. More specifically, a typical section of casing has a male thread surface on one end and a female thread surface on the other end. To string together the sections of casing, the male thread surface of one section engages the female thread surface of an adjacent section. To ensure that the interior of the casing is sealed from the surroundings in which it is positioned, an O-ring is placed around the male thread surface of each section in an O-ring groove formed adjacent the base of the thread surface, the base being where the thread surface transitions to the remainder of the casing body. The positioning of this O-ring adjacent the base of the thread surface requires the casing sections to be completely tightened for the female thread surface of the adjacent section to engage the O-ring to effectuate a seal between the sections. Furthermore, the casing oftentimes breaks or fails at the O-ring grooves because the groove reduces the wall thickness of the casing at a location which is subject to substantial stresses due to bending moments that oftentimes act upon the casing string while it is positioned in or being driven into the ground. Another disadvantage of positioning the O-ring at the base of the male thread surface is that particles and/or grease sometimes found on the male thread surface are not sealed from the interior of the casing.

Therefore, a novel ground water sampling device construction is needed to alleviate the drawbacks associated with prior art constructions.

Accordingly, it is a primary object of the present invention to provide a ground water sampling device which is constructed so that the screen for collecting water deploys from the lower end of a hollow casing string and locks in place adjacent the lower end of the casing string.

A further important object of the present invention is to provide a simple locking structure for locking the screen in place which does not project inwardly from the inner surface of the casing string and does not project outwardly from the outer surface of the screen so that a screen having a maximum diameter can be deployed through the casing string.

Another object of the present invention is to provide a sealing arrangement for ensuring that ground water cannot enter the casing except through the screen even during deployment of the screen from the casing.

A further object of the present invention is to provide a ground water sampling device in which the lower end of the screen can be opened so that a grouting device or tube can extend out of the bottom of the screen to grout the open sampling hole as the casing and screen are removed.

A still further object of the present invention is to provide a connector to connect two adjacent casing sections which provides a seal even if the casings are not adequately tightened to the connector, which prevents deleterious substances possibly found on the thread surfaces from contaminating the interior of the casing, and which allows the use of sealing O-rings without decreasing the strength of the casing string.

These and other important aims and objectives of the present invention will be further described, or will become apparent from the following description and explanation of the drawings, wherein:

FIG. 6 is a detailed cross-sectional view taken generally along line 6—6 of FIG. 3;

FIG. 7 is a fragmentary view similar to FIG. 3 and showing the housing partially retracted during the initial deployment of the screen assembly through the lower end of the housing;

FIG. 8 is a fragmentary view similar to FIG. 3 and showing the screen assembly in its fully deployed and locked position;

FIG. 9 is a detailed cross-sectional view taken generally along line 9—9 of FIG. 8 and showing the locking collar in its locked position;

FIG. 10 is an exploded perspective view of the screen assembly, locking collar, removable plug and expendable drive point removed from the housing, parts being broken away to reveal details of construction; and FIG. 11 is a fragmentary, detailed cross-sectional view of a casing connector used to connect two casing sections of the ground water sampling device together.

Figure 1:
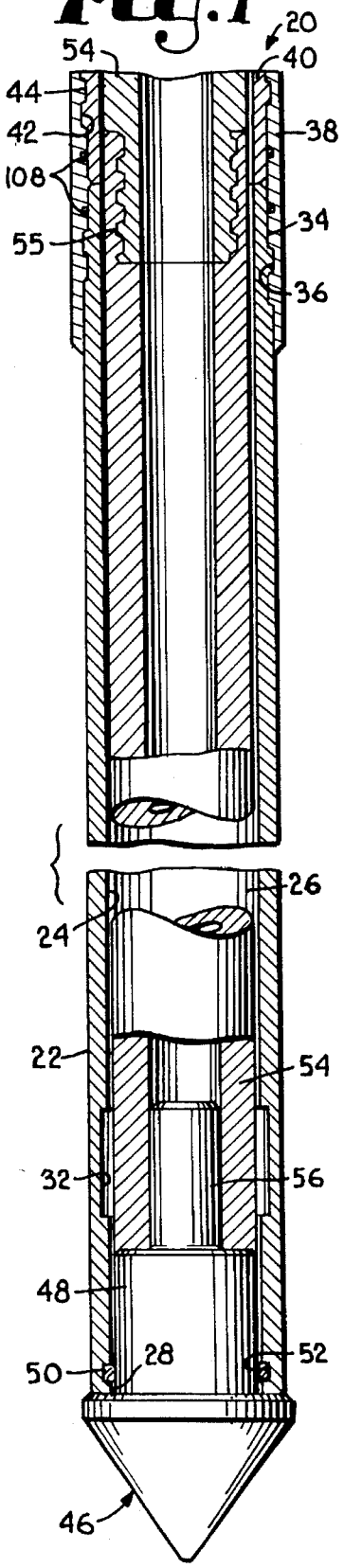
FIG. 1 is a fragmentary, detailed cross-sectional view of the ground water sampling device embodying the principles of this invention and showing the driving of a housing of the device into the ground utilizing a probe rod string disposed inside of the housing, parts being broken away and shown in cross section to reveal details of construction.
Figure 2:
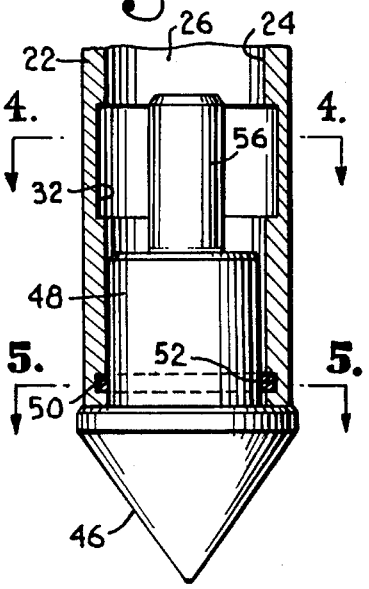
FIG. 2 is a fragmentary view similar to FIG. 1 and showing the expendable drive point positioned in its seat on the lower end of the device housing and the probe rod string removed from the housing.

A ground water sampling device embodying the principles of this invention is broadly designated in the drawings by the reference numeral 20. Device 20 includes a hollow elongated cylindrical housing 22 as best shown in FIGS. 1, 2, 4 and 5. Housing 22 has an inner surface 24 which forms a longitudinal bore 26. An opening 28 is formed adjacent the lower end of housing 22. Surface 24 has an annular locking groove 32 formed near its lower end, as best shown in FIG. 1 and 2. Groove 32 is used to lock a screen assembly in its deployed position as will be more fully described. The upper end of housing 22 has a male thread surface 34 which engages a female thread surface 36 of a connector 38. Connector 38 is used to secure housing 22 at the lower end of a string of casing sections. Connector 38 has another female thread surface 42 for engaging a male thread surface 44 of adjacent casing section 40.

Prior to a screen assembly being deployed from housing 22, the housing is driven into the ground at the lower end of a casing string. During driving of the housing, an expendable drive point 46 is positioned at the lower end of the housing. Point 46 has a solid cylindrical connecting section 48 which is received in opening 28 to connect the drive point to the housing. Bore 26 of the housing is sealed during driving by an O-ring 50 made of resilient material and positioned in an annular slot 52 formed adjacent opening 28.

To drive housing 22 to a desired depth below the ground surface, a string of probe rod sections 54 is disposed in bore 26 of the housing and in the aligned bores of the casing string. FIG. 1 depicts the driving of the housing into the ground using the probe rod sections disposed in the aligned central bores of the housing and the casing sections. The probe rod sections are connected together at a location 55 by a male/female thread arrangement. The lowermost probe rod section 54 engages section 48 of drive point 46. Point 46 further has a solid aligning stem 56 which is received in the central bore of the probe rod section. The probe rod string is used to convey most of the percussive forces from the hydraulic hammer (not shown) to the drive point. Probe rod sections 54 are typically thicker, more sturdy, and more able to bear the percussive forces of the hammer than the housing or the casing sections. The hammer acts upon the housing and the casing sections, but only to force them downwardly through the hole bored by the drive point. The lengths of the casing sections generally correspond to the lengths of the probe rod sections. Therefore, after a particular casing section and probe rod section is driven into the ground, additional casing sections and probe rod sections can be added until the desired depth of the housing is reached. Housing 22, expendable drive point 46, casing sections 40 and probe rod sections 54 are all preferably made of a metal material, for example, tool steel.

Figure 4:
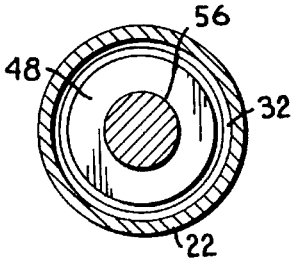
FIG. 4 is a detailed cross-sectional view taken generally along line 4—4 of FIG. 2.
Figure 5:
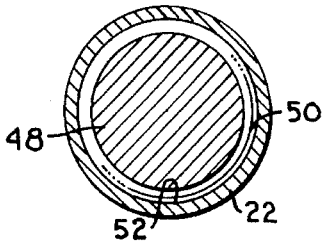
FIG. 5 is a detailed cross-sectional view taken generally along line 5—5 of FIG. 2.

After the desired depth of the housing has been reached, the probe rod string is removed. The probe rod string is removed one section at a time utilizing a pull cap as is well known in the art. FIGS. 2, 4 and 5 depict the lower end of the housing and the expendable drive point after the probe rod string has been removed.

Figure 3:
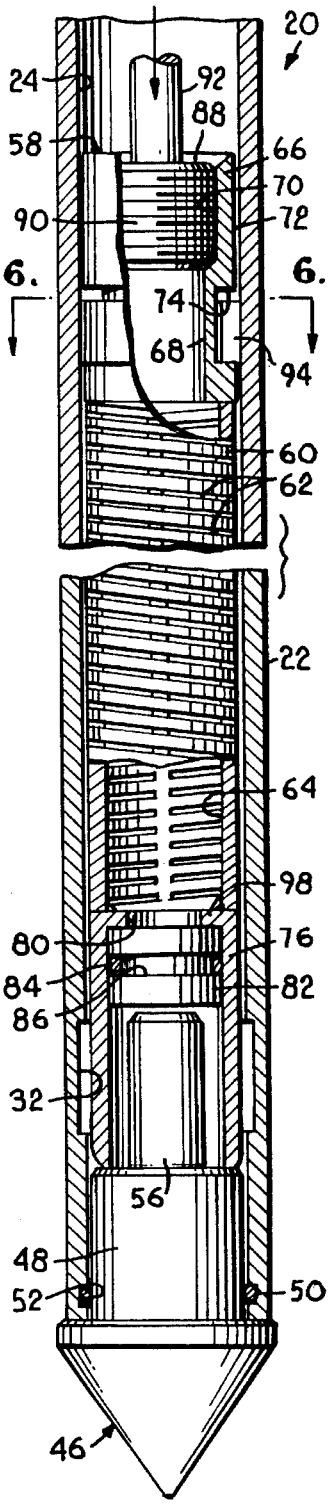
FIG. 3 is a fragmentary, detailed cross-sectional view of the ground water sampling device of FIG. 1 showing the screen assembly positioned in the housing prior to its deployment.

A screen assembly 58 can now be lowered through the aligned bores of the casing and into housing 22. FIG. 3 depicts the assembly 58 positioned within housing 22 prior to the deployment of the assembly. With reference to FIG. 10, assembly 58 includes a hollow screen 60 which has a plurality of slits 62 therein which, when the screen is deployed, will allow ground water to enter the interior 64 of the screen while at the same time preventing particles from entering the interior.

Screen 60 has an end member 66 connected to its upper end. Member 66 has a central bore 68 which is in spatial communication with the interior of the screen, as best shown in FIG. 3. Bore 68 has a female thread surface 70 formed adjacent its upper end for engagement with a connecting member 88 used to lower the screen assembly downwardly into the housing as will be more fully described. An outer surface 72 of member 66 has an annular locking slot 74 formed thereon.

Screen 60 also has an end member 76 attached to its lower end. Member 76 has a central bore 78 which is in spatial communication with the interior of screen 60 through an aperture 80, as best shown in FIG. 3. A removable plug 82 is disposed in bore 78 through the bore's lower open end and serves to seal aperture 80 and thus the interior of screen 60 from water entering through the aperture when the screen is deployed. To accomplish the sealing, plug 82 has an O-ring 84 positioned in an annular channel 86 formed on the outer surface of the plug, as best shown in FIGS. 3 and 10. Screen 60, plug 82, and end members 66 and 76 are all preferably made of a metal material, for example, stainless steel.

To lower screen assembly 58 into housing 22 through the casing string, upper end member 66 is attached to connecting member 88 by engaging a male thread surface 90 of the connecting member with female thread surface 70 of end member 66, as best shown in FIG. 3. Member 88 is attached to a solid extension rod section 92. A plurality of extension rod sections connected together at their ends are used to lower the screen assembly from the open upper end of the casing string, downwardly through the casing string, and into the housing, as shown in FIG. 3.

Prior to the screen assembly 58 being positioned in the bore of the casing section exposed at the ground surface, a locking collar 94 is positioned in locking slot 74 as generally shown in FIG. 10. Collar 94 is generally C-shaped and is made of a resilient material, for example, polyvinyl chloride (PVC), or stainless steel spring stock. The outer diameter of the collar at outer surface 96 is larger than the outer diameter of member 66 at outer surface 72 so that surface 96 extends outwardly beyond surface 72 when collar 94 is disposed in slot 74 in its undeformed uncompressed state. However, the outer uncompressed diameter of the collar is also larger than the diameter of the bores of the casing string and the diameter of bore 26 of housing 22 so that, as assembly 58 is positioned in the top of the casing string, collar 94 is compressed inwardly into slot 74 to fit the collar within the bore of the casing string. After insertion of the assembly, the collar expands slightly outwardly so that its outer surface will engage the inner surface of the bores of the casing string and also the inner surface 24 of the housing 22, as best shown in FIGS. 3 and 6. Thus, as screen assembly 58 is lowered down the casing string into the housing, outer surface 96 of collar 94 engages the inner surface of the aligned bores of the casing string and the inner surface 24 of the housing when longitudinally adjacent to these structures.

Assembly 58 is lowered until it is completely received in housing 22 and the lower end member 76 engages connecting member 48 of the drive point, as shown in FIG. 3. In this position, stem 56 of the drive point is received in bore 78 of end member 76. The screen assembly is now ready to be deployed to collect water samples.

With reference to FIG. 7, in order to deploy screen assembly 58 through opening 28 at the lower end of housing 22, the housing 22 is pulled upwardly a distance equal approximately to the length of assembly 58. The housing is pulled upwardly by partially extracting the casing string from the ground. At the same time the housing is pulled upwardly, downward force is exerted on the screen assembly through the string of extension rods 92 to hold the assembly in place. Thus, with the upward movement of the housing, expendable drive point 46 is disengaged from its seat in opening 28 and from within O-ring 50.

As shown in FIG. 7, the diameter of the outer surface of end member 76 is approximately the same as the diameter of the outer surface of connecting section 48. Thus, as housing 22 is moved upwardly, O-ring 50 is transferred from connecting section 48 to end member 76, and thereafter to screen 60. This sealing arrangement ensures that, even during the deployment of screen assembly 58, ground water can only enter housing 22 through screen 60. Thus, gravel or particles found in the ground water are prevented from contaminating the housing and the possible resulting inaccurate samples or damage to sampling equipment are averted. As is apparent from the above discussion, the housing is completely sealed during driving by O-ring 50 engaging connecting section 48 and is further sealed during the entire deployment procedure by O-ring 50 engaging end member 76 and screen 60.

Housing 22 is pulled upwardly until slot 74 of end member 76 is aligned with groove 32 of housing 22 and collar 94 expands into groove 32 to lock the assembly in place. More specifically, as slot 74 and groove 32 are longitudinally aligned with one another, the compressed collar 94 expands outwardly into groove 32. The diameter of groove 32 is slightly less than the diameter of collar 94 so that the collar is still slightly compressed. Further, the depth of groove 32 is less than the thickness of the collar 94 so that the collar is disposed partially in groove 32 and partially in slot 74, as best shown in FIGS. 8 and 9. This overlapping relationship prevents longitudinal movement of the screen assembly with respect to the housing to lock the screen assembly in its completely deployed position. As best shown in FIG. 8, this locking arrangement allows the use of a screen assembly having a maximum diameter, that is, a diameter approximating the diameter of bore 26 of the housing. More specifically, there is no need to have a ridge extending outwardly from the screen and a ledge extending inwardly from the interior of the housing in order to stop downward movement of the screen, such structures requiring that the diameter of the screen assembly be reduced.

After the screen assembly is locked in its deployed position, connecting member 88 is disengaged from end member 66 by rotating the extension rod string to disengage thread surfaces 70 and 90. The extension rod string and connecting member 88 are then removed from the casing string and the sampling device is ready for use.

In use, a flexible tubing can be positioned down the interior of the casing string, through the housing and into the interior of the screen. The upper end of the tubing extending out of the top of the casing string is connected to a peristaltic pump so that ground water passing through the screen can be sucked upwardly and into an appropriate container for testing. Other methods that are well known in the art, for instance, the use of a bailer, can be used to collect water from the interior of the screen.

This type of sampling device is meant to be disposed at a location for an extended period of time in order to provide a monitoring well at that location. After a period of time, it may no longer be necessary to monitor ground water at the location and an operator may wish to abandon the well. The structure of the sampling device allows the operator to grout the open bore hole as the casing string, housing, and screen assembly are removed therefrom. More specifically, to grout the hole at the same time the sampling device is removed, the housing and screen assembly are first pulled upwardly a distance away from drive point 46 so that stem 56 is no longer in bore 78 and so that end member 76 is spaced from drive point 46 an adequate distance to allow plug 82 to be completely forced out of bore 78. To force plug 82 out of bore 78, an extension rod string (not shown) is positioned down the center of the casing, through the housing, through the screen, and through aperture 80 to engage the plug. By applying downward pressure on the extension rod string, the plug can be forced out of bore 78, thus opening the bottom of the screen assembly to the surroundings. A grouting device, such as a tube, is then positioned down the casing string, through the housing, through the screen, through aperture 80 and out of bore 78. Thus, grout can flow downwardly through the grouting tube and into the bore hole at the same time the casing string housing and screen assembly are being removed. This is an advantage over typical prior art structures wherein it was necessary to completely remove the monitoring well before grouting and wherein it was often necessary to reposition a probe rod string through the vacant bore hole to supply grout to the lower depths of the hole. Thus, the provision of plug 82 allows a user to easily and effectively grout a hole without excessive steps or procedures.

With reference to FIG. 3, it is impossible for plug 82 to be forced upwardly within the interior of screen 60 due to its engagement with ledge 98 surrounding aperture 80. Further, downward movement of the plug is prevented when the screen is deployed by the positioning of stem 56 of drive point 46 within bore 78. Thus, the plug completely seals the bottom of the screen until it is desirable to remove the plug to grout the abandoned bore hole.

With reference to FIGS. 1 and 11, annular connector 38 will be further described. As described and shown in FIG. 1, a connector 38 is used to connect housing 22 to adjacent casing section 40. Furthermore, additional connectors 38 are used to attach the casing sections above housing 22 to one another to form the casing string. One such connection between casing sections 100 and 102 is shown in FIG. 11. To utilize connectors 38, each end of a casing section will have a male thread surface 104 formed thereon. The male thread surface of section 100 and the male thread surface of section 102 engage the female thread surfaces 42 and 36 of connector 38, respectively. An annular intermediate portion 106 of the inner surface of the connector is formed between female thread surfaces 36 and 42. A pair of spaced apart O-rings 108 are positioned in a pair of spaced apart O-ring grooves 110 formed on intermediate portion 106. The upper O-ring 108 engages the lower end of section 100 while the lower O-ring 108 engages the upper end of section 102. This sealing arrangement completely seals the interior of the casing string from its surroundings to prevent contamination.

The use of the connector with the O-rings positioned at the intermediate portion is advantageous for a number of reasons. First, because, as shown in FIG. 11, the end 112 of section 100 and the end 114 of section 102 will engage their respective O-rings prior to the casing sections reaching their tightened position, the interior of the casing string will be sealed from its surroundings even if the sections are not properly tightened to the connector. Additionally, positioning the O-rings so that they seal the very ends of sections 100 and 102 ensures that if any dirt, grease or deleterious material is deposited on the male thread surfaces of the sections, such material is prevented from entering the interior of the casing string. Still further, by positioning the O-ring grooves 110 on the connector as opposed to positioning them on the casing sections themselves, it has been found that the likelihood of breakage or failure due to, for instance, bending moments applied to the casing string, has been reduced. More specifically, the provision of the O-ring grooves in the connector does not reduce the wall thickness of the casing sections, the increased stresses at such reduced sections often resulting in failure at those sections.

Having described the invention, what is claimed is:

1. A ground water sampling device comprising:

an elongated hollow cylindrical housing positioned at a desired depth below the ground surface and having an opening formed on its lower end, said housing also having an inner surface with an annular groove disposed thereon adjacent said opening;

an elongated screen capable of being telescopically received in said housing and capable of being deployed through said opening of said housing, said screen having an annular slot formed on its outer surface adjacent its upper end; and a resilient locking collar, wherein said collar is compressed inwardly and received in said slot of said screen when said screen is received in said housing prior to the deployment of said screen, and wherein said collar expands outwardly into said groove when said slot of said screen and said groove are longitudinally aligned during deployment of the screen, said collar in its expanded position being disposed in both said slot and said groove so that said screen is locked in its deployed position.

2. The sampling device of claim 1 wherein the outer diameter of said collar in its uncompressed condition is greater than the inner diameter of said housing at said groove, and wherein the depth of said groove is less than the thickness of said collar so that said groove cannot accept the entire thickness of said collar.

3. The sampling device of claim 1 wherein said locking collar is generally C-shaped.

4. The sampling device of claim 1 further comprising:

an expendable drive point positioned at the lower end of said housing, said drive point having a cylindrical connecting portion for receipt in said opening of said housing;

a resilient O-ring disposed adjacent the lower end of said housing and in an O-ring slot formed on the inner surface of said housing, said O-ring receiving said connecting portion of said drive point so that said housing is sealed during driving of the housing into the ground and prior to deployment of said screen; and wherein the lower end of said screen has substantially the same diameter as said connecting portion of said drive point so that the lower screen end replaces said connecting portion in said O-ring during deployment of said screen to seal said housing from ground water except for ground water entering through said screen.

5. The sampling device of claim 4 wherein the lower end of said screen has a bore formed therein, said device further comprising a removable cylindrical plug disposed in said bore to seal the lower end of said screen, said plug capable of being forced downwardly through an open lower end of said bore from the ground surface so that a grouting device can extend through said bore and out of the bottom of said screen to grout the open hole as said housing and screen are removed.

6. The sampling device of claim 5 wherein said plug includes a resilient O-ring disposed in a slot formed on the outer peripheral surface of said plug.

7. The sampling device of claim 1 wherein said housing includes a male thread surface formed on said upper end, said housing being connected to a lower end of a string of casing rods by a connector, said connector comprising:

a cylindrical body having an inner surface forming a cylindrical bore having a first open end and a second open end, said inner surface having a first female thread surface formed adjacent said first open end for engaging said male thread surface of said housing and a second female thread surface formed adjacent said second open end for engaging a male thread surface of an adjacent casing section, said inner surface having an intermediate portion formed between said first and second female surfaces, a first O-ring disposed in a first groove formed on said intermediate portion, said O-ring engaging the upper end of said housing; and a second O-ring disposed in a second groove formed on said intermediate portion and longitudinally spaced from said first groove, said second O-ring engaging the lower end of the adjacent casing section so that the connected interior bores of said housing and the adjacent casing are sealed.

* * * * *